US011098443B2

(12) United States Patent
Siniscalchi et al.

(10) Patent No.: US 11,098,443 B2
(45) Date of Patent: Aug. 24, 2021

(54) METHOD FOR MAKING A THERMOINSULATING PADDING, PARTICULARLY FOR THE CLOTHING AND FURNISHING FIELDS

(71) Applicant: FISI FIBRE SINTETICHE S.P.A., Oggiono (IT)

(72) Inventors: Lucio Siniscalchi, Oggiono (IT); Marciano Siniscalchi, Oggiono (IT)

(73) Assignee: FISI FIBRE SINTETICHE S.P.A., Oggiono (IT)

( * ) Notice: Subject to any disclaimer, the term of this patent is extended or adjusted under 35 U.S.C. 154(b) by 384 days.

(21) Appl. No.: 14/389,753

(22) PCT Filed: Apr. 23, 2013

(86) PCT No.: PCT/IB2013/000754
§ 371 (c)(1),
(2) Date: Sep. 30, 2014

(87) PCT Pub. No.: WO2013/171557
PCT Pub. Date: Nov. 21, 2013

(65) Prior Publication Data

US 2015/0061178 A1 Mar. 5, 2015

(30) Foreign Application Priority Data

May 17, 2012 (IT) ..... MI2012A000854

(51) Int. Cl.
*D06M 15/705* (2006.01)
*D06M 15/263* (2006.01)
(Continued)

(52) U.S. Cl.
CPC ..... *D06M 15/263* (2013.01); *D04H 1/4274* (2013.01); *D04H 1/54* (2013.01);
(Continued)

(58) Field of Classification Search
CPC ..... D04H 1/593
See application file for complete search history.

(56) References Cited

U.S. PATENT DOCUMENTS 3,323,959 A 6/1967 Kreckl
3,608,044 A * 9/1971 Coplan ..... D01F 6/66 264/210.7

(Continued)

FOREIGN PATENT DOCUMENTS

EP 0297199 A2 1/1989
EP 0365491 A2 4/1990

OTHER PUBLICATIONS

International Search Report in corresponding PCT application dated Sep. 11, 2013.

*Primary Examiner* — Jeffrey M Wollschlager
*Assistant Examiner* — Armand Melendez
(74) *Attorney, Agent, or Firm* — Hedman & Costigan, P.C.; James V. Costigan; Kathleen A. Costigan

(57) ABSTRACT

A method for making a thermoinsulating padding, particularly for the cloth article and furniture fields, comprises the steps of: providing a lap by carding in bulk fibers comprising at least a thermobinding fiber; applying, by spraying or spreading, a low glass transition temperature resin, or a mixture of resins comprising at least a low glass transition temperature resin at least on a side of said lap only to the surface layers of said side; drying the resin coated lap in a drying oven to start a cross linking of said resins; actuating said low glass transition temperature resin (previously applied either individually or in a mixture with other resins) by pressure calendering under a controlled temperature, thereby providing a dynamically operating padding.

5 Claims, 3 Drawing Sheets

(51) Int. Cl.

| | |
|---|---|
| ***D04H 1/4274*** | (2012.01) |
| ***D04H 1/558*** | (2012.01) |
| ***D04H 1/541*** | (2012.01) |
| ***D04H 1/54*** | (2012.01) |
| ***D04H 1/64*** | (2012.01) |
| ***D06M 15/568*** | (2006.01) |
| ***D06M 15/71*** | (2006.01) |

(52) U.S. Cl.
CPC ..... *D04H 1/541* (2013.01); *D04H 1/558* (2013.01); *D04H 1/64* (2013.01); *D06M 15/568* (2013.01); *D06M 15/705* (2013.01); *D06M 15/71* (2013.01)

(56) References Cited

U.S. PATENT DOCUMENTS

| | | | | | |
|---|---|---|---|---|---|
| 4,957,804 | A * | 9/1990 | Hendrix | B32B 7/02 | 428/212 |
| 5,593,746 | A * | 1/1997 | Siniscalchi | D04H 1/587 | 19/98 |
| 5,614,303 | A * | 3/1997 | Baigas, Jr. | B32B 5/26 | 442/247 |
| 5,710,080 | A * | 1/1998 | Pellegrini | B32B 5/08 | 442/304 |
| 5,873,964 | A | 2/1999 | Kwok | | |
| 2011/0073239 | A1* | 3/2011 | Manning | B32B 5/02 | 156/62.2 |
| 2011/0293911 | A1* | 12/2011 | Coates | B32B 5/26 | 428/220 |

* cited by examiner

METHOD FOR MAKING A THERMOINSULATING PADDING, PARTICULARLY FOR THE CLOTHING AND FURNISHING FIELDS

BACKGROUND OF THE INVENTION

The present invention relates to a method for making a thermoinsulating padding, particularly for clothing and furnishing fields.

As is known, winter clothing articles, such as windcheaters comprise an insulating material padding of different nature.

For example, paddings consisting of a non-woven fabric or synthetic fiber material such as polypropylene or polyester fibers are well known.

To reduce the thickness of the padding, wadding or padding materials having a low weight for square meter are conventionally used, or the wadding material is suitably needled.

However, such a needling processing operation causes the wadding or padding material to be partially crushed and greatly hardened, thereby reducing the softness of the garment made from a thus processed padding.

Moreover, prior paddings have a relatively low thermal resistance value, and do not have with good finishing characteristics.

In this connection, it should be pointed out that the insulating properties of the padding layers depend, among other things, on a proper ratio between the padding density and air amount restrained in the padding forming fibers.

SUMMARY OF THE INVENTION

Accordingly, the aim of the present invention is to provide a method for making a thermoinsulating and thermoadjusting padding, for clothing and furnishing fields, overcoming the above mentioned drawbacks of prior like paddings.

Within the scope of the above mentioned aim, a main object of the invention is to provide a method which is advantageously improved from an ecosustainability standpoint of the end product made thereby, by using recycled, post-consumer and post-industrial fibers.

Another object of the present invention is to provide such a method allowing to achieve a padding having an improved thermoinsulating and thermoadjusting power, with a simultaneous good stability and cohesion of the padding fibers.

Another object of the present invention is to provide such a method allowing to reduce the power consume necessary for making the padding.

Another object of the present invention is to provide such a method allowing to greatly reduce the amount of used fibers and resin materials.

According to one aspect of the present invention, the above mentioned aim and objects, as well as yet other objects, which will become more apparent hereinafter, are achieved by a method for making a thermoinsulating padding, particularly for clothing and furnishing fields, characterized in that said method comprises the steps of:

Providing a lap by carding a block bulk fibers comprising at least a thermocohesioning fiber;

Applying at least a low glass transition temperature, at least on a side of the lap and only to surface layers of said lap side;

Drying the resin processed lap in a drying oven, while starting the resin crosslinking;

Actuating the low glass transition temperature resin by calendering under controlled temperature and pressure conditions.

A further characteristic of the invention is that the inventive padding has dynamically variable thermal characteristics, thereby, at a temperature larger than 37° C., and substantially up to 41° C., said lap has a larger thermal dispersion, from 10% to 50% with respect to the thermal dispersion detected at a temperature less than 37° C.

Advantageously, the fibers may comprise recycled (post-consumer and post-industrial) fibers.

A further advantage is the overall lower consumption of the base-resin because the base-resin is partially replaced by thermocohesioned fibers.

Moreover, the drying step requires a lap less oven maintenance time, which reduces the power required for performing the process.

The above characteristics contribute to enhance the eco-sustainability of the end or finished product.

Optionally, after the first resin applying step, the resin is also applied on the lap non processed side, only to the surface layer of the latter.

The resin applied on the lap non processed side may be either a low glass transition temperature resin or a conventional resin.

BRIEF DESCRIPTION OF THE DRAWINGS

Further characteristics and advantages of the present invention will become more apparent hereinafter from the following detailed disclosure of a preferred, though not exclusive, embodiment of the invention which is illustrated, by way of an indicative but not limitative, example, in the accompanying drawings, where.

DESCRIPTION OF THE PREFERRED EMBODIMENTS

With reference to the number references of the above mentioned figures, the method for making a thermoinsulating padding, particularly for clothing and furnishing fields according to the present invention, provides a padding generally indicated by the reference number 1.

The main components of the inventive padding are four in number: base or basic fibers, thermocohesioning fibers, base resins, and low glass transition temperature resins.

The base fibers, preferably of a polyester, polyolefine or acrylic type, are used in fiber mixtures comprising different thickness fibers (from 0.5 to 20 deniers) and finishing (in particular consisting of a silicone processing finishing).

The thermocohesioning fiber is a bi-component fiber, the outer layer of which has a comparatively low melting temperature, from 100° C. to 150° C., whereas the central core has characteristics similar to those of the base fibers.

Said thermocohesioning fibers may be used as a partial replacement of the resins, as it will be disclosed hereinafter.

The fiber provided of available thicknesses typically change from 1 to 6 deniers.

Figure 1:
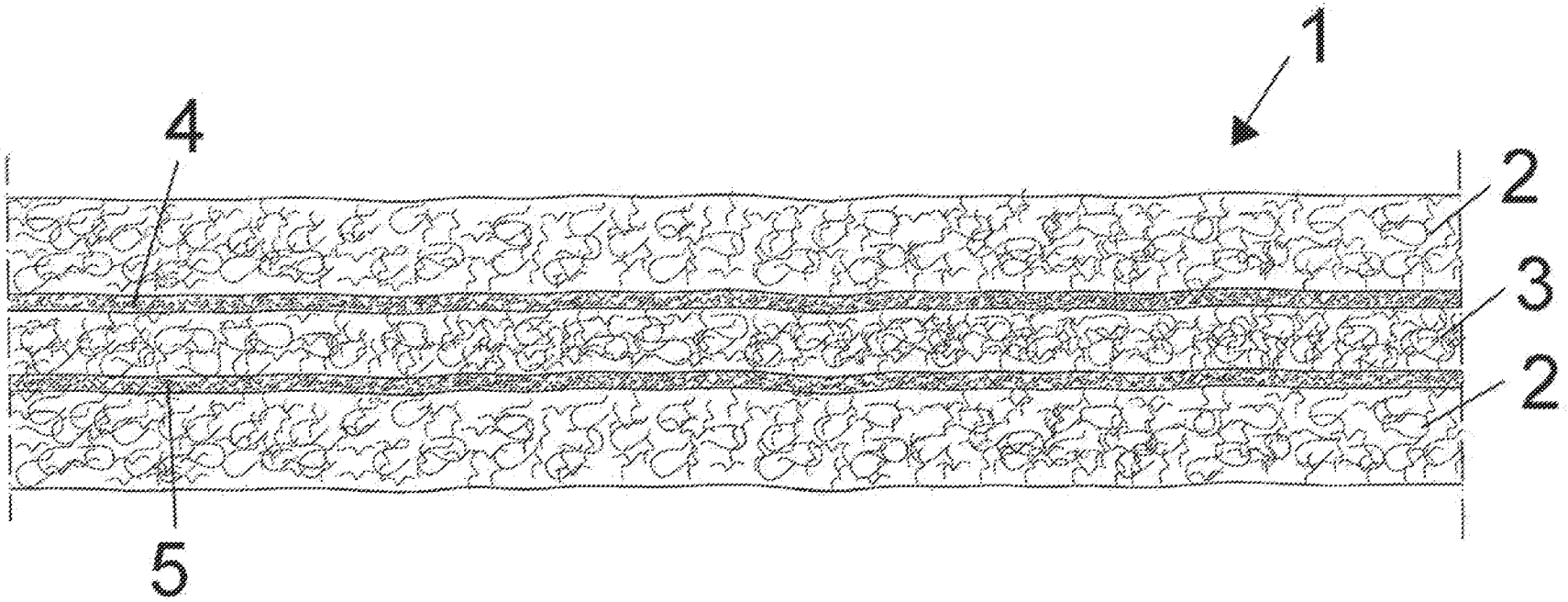
FIG. 1 is a cross-sectional view of a padding made by a method according to the present invention.
Figure 2:
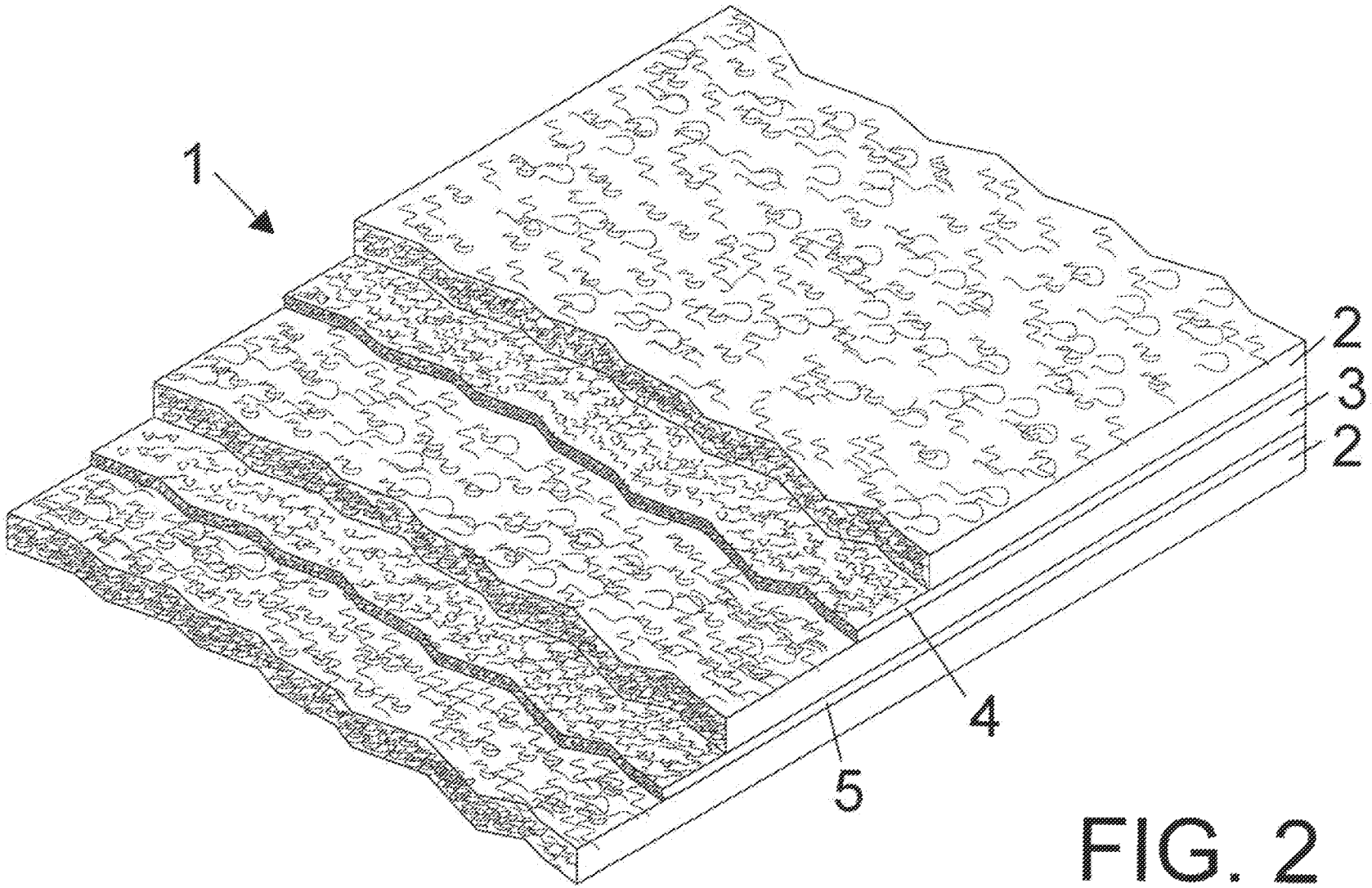
FIG. 2 is a partially broken-away perspective view of the inventive padding.
Figure 3:
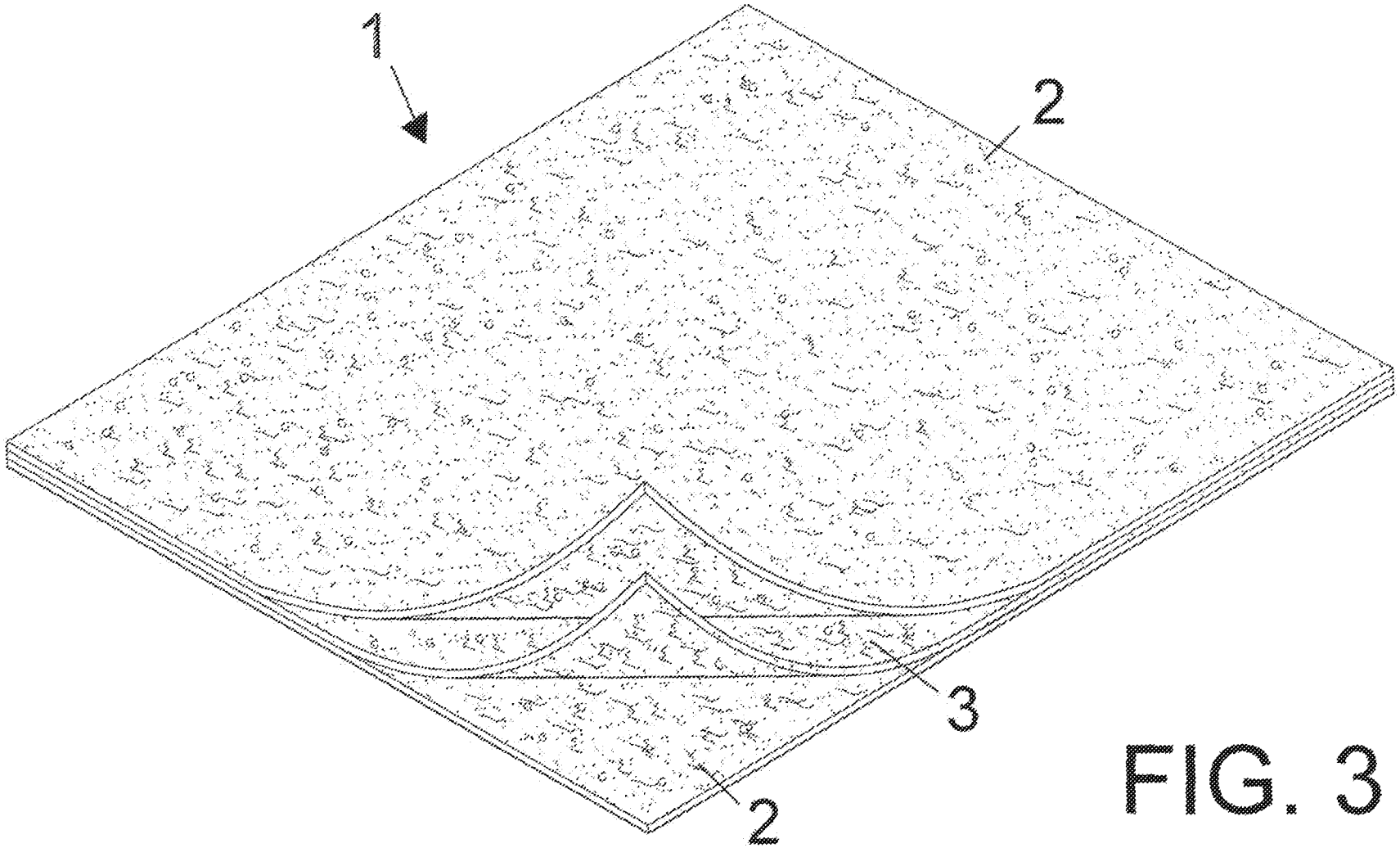
FIG. 3 is a further perspective view of the inventive padding in which the layer flaps thereof have been partially raised.

With reference to FIG. 1, a non exclusive embodiment of the invention provides to use base fibers 2 in outer layers, and a mixture of base fibers and thermocohesioning fibers in the inner layers 3.

Modified embodiments of the inventive method provide to use base and thermocohesioning fibers in all the lap layers, or in all the lap layers with the exception of the surface layers of only one of the two lap sides.

The precise resin composition is of very great importance to achieve the desired or target mechanical and thermal characteristics.

Preferably, the base resins comprise emulsions of acrylic and metacrylic copolymers, ethylene-vinylacetate copolymers, styrene and butadiene copolymers or butadiene or acrylonitrile copolymers.

As the resins applied either on one or both the outer layers of the finished or end product, are herein provided low glass transition temperature (Tg) resins, preferably emulsions of polyurethane, aliphatic or aromatic resins (from polyethers and polyesters) as well as acryl and meta-acryl copolymers, ethylene-vinylacetate copolymers, styrene and butadiene copolymers, butadiene-acrylonitrile copolymers, and natural rubber latex materials.

The low glass transition temperature resin is applied on at least one of the two outer sides of the lap.

A modified embodiment of the present invention provides to apply the resin on both the lap sides.

Both the base resins and the low glass transition temperature resins may be added with crosslinking agents, surface active agents, antifoaming and the like agents depending on application.

A characterizing feature of the inventive method is to apply the low glass transition temperature resin only on the outer fiber webs or layers, to be subjected to a controlled pressure and temperature calendering step.

Another characterizing feature is to use low glass transition temperature resins in combination with thermocohesioning fibers.

The latter will provide a proper cohesion of the padding body, thereby allowing to apply the low glass transition temperature resin essentially only on the surface of the padding, thereby maximizing the thermostabilizing effect thereof.

The use of the mentioned thermocohesioning fibers provides further advantages.

At first, a reduction of the overall amount of resin is achieved, without negatively affecting the mechanical characteristics of the padding, such as size stability, owing to the presence of the thermocohesioning fibers.

A further advantage is that, during the resin drying and crosslinking step, the heat absorption, and accordingly the power consume, will depend on the resin emulsion water, and not on the fibers, the thermal power of which is negligible with respect to the water evaporating heat.

Accordingly, by reducing the resin amount, also the power consume will be correspondingly reduced.

A quantitative evaluation of such, a power consume reduction will be disclosed hereinafter.

Moreover, the use of thermocohesioning fibers is important for preserving the finished or end product size stability as recycled fibers are used therein.

In fact, recycled fibers have mechanical characteristics different from those of virgin fibers.

In particular, to prevent said fibers from exiting the lap, and accordingly projecting from the outer fabric of the finished product, for example a clothing article, it is necessary to use an increased base resin amount.

This, obviously, would partially reduce the advantages achieved by the use of recycled fibers from the ecosustainability standpoint.

According to the present invention, by using thermocohesioning fibers, the above drawback is overcome.

The method according to the present invention may be carried out according to different practical embodiments.

Since the resins, as above disclosed, are deposited only on the lap outer layers, the function of preserving the size stability of the lap will be provided by the binding fibers.

It should be apparent that, in a modified embodiment of the above disclosed method, in the third method step, the spray applying of the base resin could be also extended to the lap inner layers.

However, due to the difficulty of precisely calibrating the resin application, an amount of low glass transition temperature resin will be required.

This could reduce the thermostabilizing performance thereof.

For the above reasons, the application of the low glass transition temperature base resins should be limited to the product surface layers.

To the above it should be added that other modified embodiments of the inventive method could provide an application of base resins on both the lap sides 4 and 5, followed by an application of the low glass transition temperature resins on one only of the outer layers or on both said outer layers.

The product or article made by the above disclosed method has the main advantage that it is provided with a high washing resistance.

In practicing the invention, the used materials, as well as the contingent size and shapes can be any, according to requirements.

It has been found that the invention fully achieves the intended aim and objects.

In fact, the method according to the present invention allows to make paddings which have very good thermal insulating and user comfort properties as well as improved ecosustainability characteristics.

By way of an exemplary and non limitative example, to verify the characteristics of the present invention, some non exclusive embodiments will hereinafter disclosed, wherein;

The base fiber is constituted by a mixture comprising 50% 6-denier non silicone processed fibers, 25% 3-denier silicone processed fibers and 25% 3-denier non silicone processed fibers; said fibers comprising 50% post-consumer recycled fibers.

With reference to FIG. 1, the inner lap layers are made by a fiber mixture comprising 90% base fibers and 10% 3-denier thickness thermocohesioned fibers, whereas the outer layers are fully made of base fibers.

With respect to the resins, two possible compositions are herein considered.

1) Composition A: Base resin—100% acrylic copolymer (e.g. Polysar Latex G149—Polysar); low glass transition temperature resin—100% aliphatic polyurethanic resin (polyether) (e.g. WC-6534—Wilmington Chemical Corp.), Tg=−60.

2) Composition B: Base resin—100% acrylic copolymer (e.g. Polysar Latex G149—Polysar); low glass transition temperature resin—50% polyurethanic aromatic resin (e.g. Luphen D200A—BASF) and 50% acrylic copolymer (as above). Tg=−30 (estimated).

Both the above compositions provides to use additives, in the amount established by the respective makers: Nopco MXZ (antifoam agent), BASF Triton X100 (surface active agency), BASF Besona A270 (crosslinking agent).

The low glass transition temperature resin is applied on a side only, whereas the base resin is applied on the other side.

The following table resumes the characteristics or properties of the herein disclosed embodiments, which, as stated, are disclosed only by way of a merely exemplary and non limitative example (compositions A and B).

For comparing, are also indicated the corresponding characteristics or properties for a lap made by a conventional method (composition C) providing to use low glass transition temperature resin in a mixture with base resins, applied by spraying so as to penetrate up to the inner layers of the lap, and not using thermocohesioning fibers.

The precise composition of the resins in a reference sample is:

Low glass transition temperature resin—50% polyurethanic-aromatic resin (e.g. Luphen D200A—BASF) and 50% acrylic copolymer (as above).

Tg=−30° C. (estimated)

In all the three cases, the made padding has a weight of 150 g/m$^2$.

The thermal coibency is measured according to the standards UNI 1597/67 and referred to in "UCT" (Thermal coibency Unit).

The thermodynamic property measurement, the so-called IRD+, is based on the hereinbelow disclosed method.

| Composition | Thickness (cm) | UCT | IRD+ | Physical characteristics |
|---|---|---|---|---|
| A | 2.3 | 31.1 | 28 | Plastic to touch |
| B | 2.1 | 29.5 | 24 | Soft to touch |
| C | 2.2 | 30.2 | 23 | Soft to touch |

As stated, the technical properties and physical characteristics of the A and B compositions, made according to the subject method, are essentially like or improved with respect to those of a prior method, while allowing to use recycled fibers with an enhanced power saving (as disclosed in further details hereinafter).

The thermodynamisms test has been designed for simulating the padding performance, in a transition from a rest status to an intense physical activity status.

The test has been performed by the following testing method.

A highly thermally conductive plastic vessel has been filled-in by a given water amount, at a temperature of at least 45° C.

The vessel is coated by a jacket, made of the product to be tested, and said vessel including therein a probe of a digital thermometer, with an accuracy of +/−0.05° C.

The vessel is covered by a plug made of cork or other insulating material and arranged on a pedestal, also of an insulating material, thereby preventing heat from leaking in directions different from those covered by the product under testing.

The assembly is then placed in an environment at a temperature of 0° C.

For stabilizing the system, a period of time is required to allow water to achieve 41° C.

Then, at intervals of a precise minute, the water temperature is detected and listed in a water temperature table.

The test is ended after 20 minutes.

Then, are calculated the Dt (DeltaT=temperature variation in ° C.) for each of the 19 measurements, starting from the second, thereby providing the full hereinbelow table, representing the test resulting results:

| Time | Temperature | Dt |
|---|---|---|
| 1' | t1 | (n.a.) |
| 2' | t2 | t2-t1 |
| 3' | t3 | t3-t2 |
| . . . | . . . | . . . |
| 19' | t19 | t19-t18 |
| 0' | t20 | t20-t19 |

Then, the achieved data are analyzed and, in a case of conventional products, the Dt values are held nearly constant or subjected to negligible variations.

In the inventive product, on the contrary, the Dt values remain comparatively high in the first read-outs, with an abrupt reduction (−20%), at a temperature of about 37° C.

This means that the thermal dispersion is a high one with a temperature held at about 37° C., but, as the temperature achieves 37° C., the dispersion becomes less than 20% and, accordingly, the greater will be the amount of heat being held.

By reading-out the diagram, from the bottom to the top, from the 20$^{th}$ read-out to the first, it is possible to achieve a faithful reproduction of the events, as the person wearing a cloth article padded with the inventive padding, passes from a rest status to an intense physical activity status.

With the person in a rest or non physically stressed condition, the person temperature is held at about 37° C. and the inventive product will provide a maximum thermal coibency for assuring such a temperature.

As soon as temperature increases, because of physical movements, that same product will allow an enhanced heat exchange between the person body and environment, while preventing or limiting any transpiring.

A read-out "on fly" of the table should be sufficient to demonstrate a dynamic performance.

Anyhow, it would be useful to calculate the dynamic response index, according to the thereinbelow stated method.

By defining,

Dt37H=an average of all the Dt corresponding to temperature larger than 37° C.

Dt37C=an average of all the Dt corresponding to temperature less or equal to 37° C.

it is achieved $$IRD+=100\times(Dt37H-Dt37C)/D37C$$

and $$IRD+=100\times(Dt37H-Dt37C)/D37H$$

The IRD+value is calculated as a dispersion INCREASE as the temperature move up over 37° C. (by reading from t20 to t1), whereas the IRD− value is calculated as a DECREASE of the dispersion as the temperature move down under 37° C. (by reading from t1 to t20).

It should be apparent that, being Dt37H>=Dt37C, we will have IRD−<IRD+.

Anyhow, it should be expedient to use IRD+, since these values are more near to reality (a temperature increase due to motion).

This is the value shown in the preceding table.

Finally, are herein proposed some evaluations related to the advantages of the inventive method found in the terms of ecosustainability with respect to conventional methods.

The virgin polyester polymer has an energy contents of about 83 MJ/Hg.

A production of 1 Kg of the virgin polymers causes moreover an emission of $20*10^{-3}$ Kg $SO_2$, $9*10^{-3}$ Kg of NOx, and 3.35 Kg of $CO_2$.

Since from a combustion of a waste polyester 25 MJ/Kg would be produced, it is possible to think that a reuse of a post-consumer or post-industrial polyester would allow to recover about 40 MJ/Kg with a saving of about a half of the energy.

This considering a consume of about 18 MJ/Kg for the washing and drying steps.

Likewise, since the recycling operation involves an emission of $CO_2$ for 1.5 Kg/Kg, the use of recycled fibers will involve a reduction or 1.85 Kg/Kg of this polluting agent.

With respect to a padding having an insulating power RCT=0.4 $m^2$ K/W (corresponding to 2.58 Clo) and having a same fiber contents, the product according to the present invention has the following differences:

A less resin amount: −10 g/$m^2$ and accordingly a power saving of 0.6 MJ/$m^2$ and less $CO_2$ emissions in a degree of 0.025 Kg/$m^2$.

An equal insulating power and thermoadjusting capability, but however with a less overall weight (−8%).

Owing to the use of recycled fibers, the energy consume is reduced by 4 MJ/$m^2$ while reducing the $CO_2$ emissions by 0.16 Kg/$m^2$.

The following tables provides further details:

| | Conventional | Invention |
|---|---|---|
| Insulating power ($m^2$ K/W) | 0.4 | 0.4 |
| Weight (g/$m^2$) | 120 | 110 |
| Energy consume (MJ/$m^2$) | 9.96 | 4.5 |
| $CO_2$ (Kg/$m^2$) | 0.4 | 0.215 |
| $SO_2$ (Kg/$m^2$) | $2.4 * 10^{-3}$ | $0.7 * 10^{-3}$ |
| NO*x* (Kg/$m^2$) | $1.08 * 10^{-3}$ | $0.2 * 10^{-3}$ |

The invention claimed is:

1. A method for making a thermoinsulating non-woven padding for a cloth article and furniture applications, said method comprising the steps of:

providing a lap by carding in bulk fibers, said lap comprising a central layer and first and second outer layers, said central layer and said first and second outer layers being constituted by said bulk fibers, said bulk fibers comprising base fibers and thermobinding fibers, said base fibers comprising a mixture of virgin fibers and post-consumer and post-industrial recycled fibers, and said thermobinding fibers being bi-component fibers having an outer fiber layer with a melting temperature from 100 to 150° C.;

applying, by spraying or spreading, a base resin, at opposite sides of said central layer between said central layer and said first and second outer layers, said base resin consisting of an acrylic copolymer;

applying, by spraying or spreading, a low glass transition temperature resin, or a mixture of resins comprising at least a low glass transition temperature resin, on two outer sides of said first and second outer layers of said lap only to lap surface layers of said two outer sides, wherein said low glass transition temperature resin consisting of an aliphatic polyurethane resin or a resin consisting of 50% aromatic polyurethane resins and 50% of an acrylic copolymer wherein the base resin material added to the opposite sides of the central layer is different from the resin material applied either individually or in a mixture to the outer side of the second outer layer:

drying the resin coated lap in a drying oven to start a cross linking of said resins;

actuating said low glass transition temperature resin, previously applied either individually or in a mixture with other resins, by pressure calendering said lap under a controlled temperature;

providing said thermoinsulating non-woven padding with dynamically variable thermally adjusting properties such that at a temperature between 37° C. and 41° C. said padding having a thermal dispersion that is 10% to 50% larger that a thermal dispersion of said padding at a temperature less than 37° C., and the method being carried out without a needling processing step such that the thermoinsulating non-woven padding made by said method does not have any needled portions.

2. A method, according to claim 1, characterized in that said base-fibers comprise polyester, polyolefine or acrylic fibers and that said base-fibers are used in fiber mixtures comprising fibers of different thicknesses from 0.5 to 20 deniers; said base fibers being subjected to a finishing step consisting of a silicone processing step.

3. A method, according to claim 1, characterized in that said method comprises the step of using said thermobinding fibers having thicknesses varying from 1 to 6 deniers.

4. A method, according to claim 1, characterized in that both said base resin and said low glass transition temperature resin are added with surface active cross-linking agents and antifoaming agents.

5. A method, according to claim 1, characterized in that said method further comprises the step of using a base-fiber consisting of a fiber mixture comprising 50% non silicone processed 6-denier fibers, 25% silicone processed 3-denier fibers and 25% non silicone processed 3-denier fibers, said fibers being, in a rate of 50%, post-consumer recycled fibers.

* * * * *